United States Patent [19]

Llach et al.

[11] 3,982,301

[45] Sept. 28, 1976

[54] VARIABLE DRIVE MECHANISM FOR CARDING MACHINE

[76] Inventors: Lawrence Llach, Rte. 6, Oakdale Road, Canton, Ga. 30114; Arturo Picas, 150 Viking Court No. 4, Athens, Ga. 30601

[22] Filed: Jan. 29, 1975

[21] Appl. No.: 545,195

[52] U.S. Cl. ..... 19/.25; 19/106 R

[51] Int. Cl.[2] ..... D01G 31/00; D01G 15/46

[58] Field of Search ..... 19/98, 106 R, 105, .2, 19/.21, .25; 74/230.17 A, 230.18, 244

[56] References Cited

UNITED STATES PATENTS

| | | | |
|---|---|---|---|
| 605,057 | 5/1898 | Hopkinson et al. | 19/106 R |
| 3,270,374 | 9/1966 | Yon, Jr. | 19/.25 |
| 3,300,817 | 1/1967 | Binder et al. | 19/.21 |

FOREIGN PATENTS OR APPLICATIONS

| | | | |
|---|---|---|---|
| 988,588 | 4/1965 | United Kingdom | 19/106 R |

*Primary Examiner*—Dorsey Newton
*Attorney, Agent, or Firm*—Jones, Thomas & Askew

[57] ABSTRACT

A high production textile card system is provided with an automatic variable speed drive system for driving the doffing cylinder from the main cylinder at a slow speed during system start-up and then progressively increasing the speed of the doffing cylinder after start-up. A variable speed belt drive system and clutch system are responsive to the sliver detector switch at the coiler can to control the rotation of the doffing cylinder after the system startup time has elapsed, to either terminate the rotation of the doffing cylinder if the sliver has not been properly threaded through the coiler head, or to increase the speed of rotation of the doffing cylinder with respect to the speed of rotation of the main cylinder.

3 Claims, 3 Drawing Figures

VARIABLE DRIVE MECHANISM FOR CARDING MACHINE

BACKGROUND OF THE INVENTION

In the manufacture of cotton yarn, a sliver is normally prepared by forming a web of fibers from individual fibers, by working the web to align and refine the fibers, by forming the web into a sliver, and by coiling the sliver. The sliver is subsequently drawn out and twisted to form the yarn. The working of the web is done in a textile card, and the web must be as thin as possible and must be handled carefully because it is so thin and fragile. The web enters the carding machine at the feed roll, passes to a licker-in, to the main cylinder, is doffed from the main cylinder at the doffing cylinder, is combed from the doffing cylinder and passed through a trumpet where it is formed into a sliver. The sliver moves from the trumpet through various calendering rolls and guides to a coiler head and a coiler can where the sliver is coiled and temporarily stored. The web and sliver are very fragile, and it is difficult to form and maintain the web and sliver during the initial start-up of the card. Because it is difficult to start the card, the speed of rotation of the doffing cylinder is preferably variable with respect to the speed of rotation of the main cylinder so that the doffing cylinder can be operated at a slow speed of rotation during start-up of the system to produce a thick, strong web which can be handled without tearing when taken from the doffing cylinder and passed through the trumpet and to the coiler can. After the start-up of the card has been completed, the speed of rotation of the doffing cylinder can be increased with respect to the speed of rotation of the main cylinder, thus further working and drawing out the web.

At the present time, many of the cards in operation are operated at a constant speed. In order to prevent the web or sliver from tearing or breaking during the start-up, the carding machines are operated at a relatively slow speed. Although the slow speeds allow continuous production of the sliver with relatively few machine shut-downs due to breakage of the web or sliver, the overall production rate of the sliver is slow, and therefore unsatisfactory. While some carding machines include means for varying the doffing cylinder speed with respect to the main cylinder speed, when the prior art systems are turned off, the driving belt and other elements associated with the system cause the doffing cylinder to continue rotating before the system is completely stopped. In addition, the present carding systems which do include variable speed doffing cylinders usually require the card operator to manually change the speed of the doffing cylinder, and if the operator fails to change the speed of the doffing cylinder promptly after start-up, the web is not properly worked.

SUMMARY OF THE INVENTION

Briefly described, the present invention comprises a drive system for a high production textile card system wherein the speed of rotation of the doffing cylinder is variable with respect to the main cylinder and wherein the rotation of the doffing cylinder can be terminated rapidly and independently of the main cylinder when the operation of the card is terminated. When the operation of the card is initiated, the doffing cylinder is rotated at a relatively slow speed during a predetermined time delay or start-up period so that the card operator can guide the dense strong sliver to the coiler head and sliver coiler can. The time delay is calibrated so as to allow the operator enough time to properly start the machine, and when the start-up time has elapsed, the system detects the proper movement of the sliver toward the coiler can and progressively increases the rotational speed of the doffing cylinder with respect to the speed of rotation of the main cylinder of the card. If the sliver detector determines that the sliver has not been properly threaded into the coiler can, the card is shut down and the drive system to the doffing cylinder is disengaged to allow the rotation of the doffing cylinder to terminate independently of the rotation of the main cylinder.

Thus, it is an object of the present invention to provide an improved drive system for a high production textile card which rotates the doffing cylinder at a relatively slow speed with respect to the main cylinder during a predetermined period of time required for starting the system and for moving the sliver to the sliver coiler can, and after the machine is operating properly at a slow speed, increases the speed of rotation of the doffing cylinder with respect to the main cylinder.

Another object of the present invention is to provide an inexpensive and reliable variable drive system for a textile card which allows the rotation of the doffing cylinder to proceed at slow speed during start-up procedure and which automatically increases the speed of operation of the doffing cylinder after a time delay if the sliver is properly threaded into the coiler can, or which automatically terminates the operation of the card if the sliver has not been properly threaded into the coiler can.

Other objects, features and advantages of the present invention will become apparent upon reading the following specification, when taken in conjunction with the accompanying drawing.

DETAILED DESCRIPTION OF AN EMBODIMENT OF THE INVENTION

Figure 1:
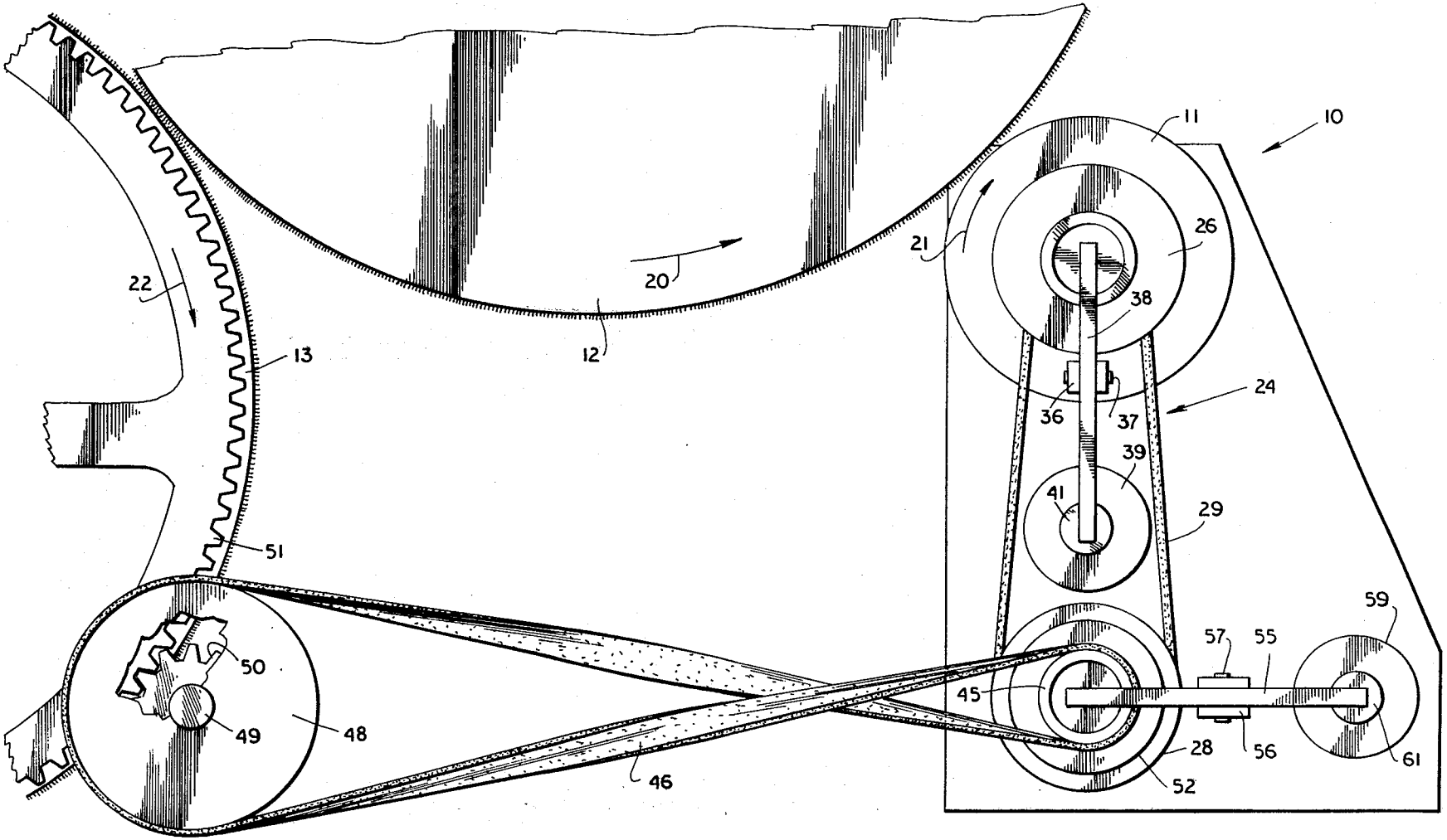
FIG. 1 is a schematic side elevational view of the variable speed drive system of the doffing cylinder.
Figure 3:
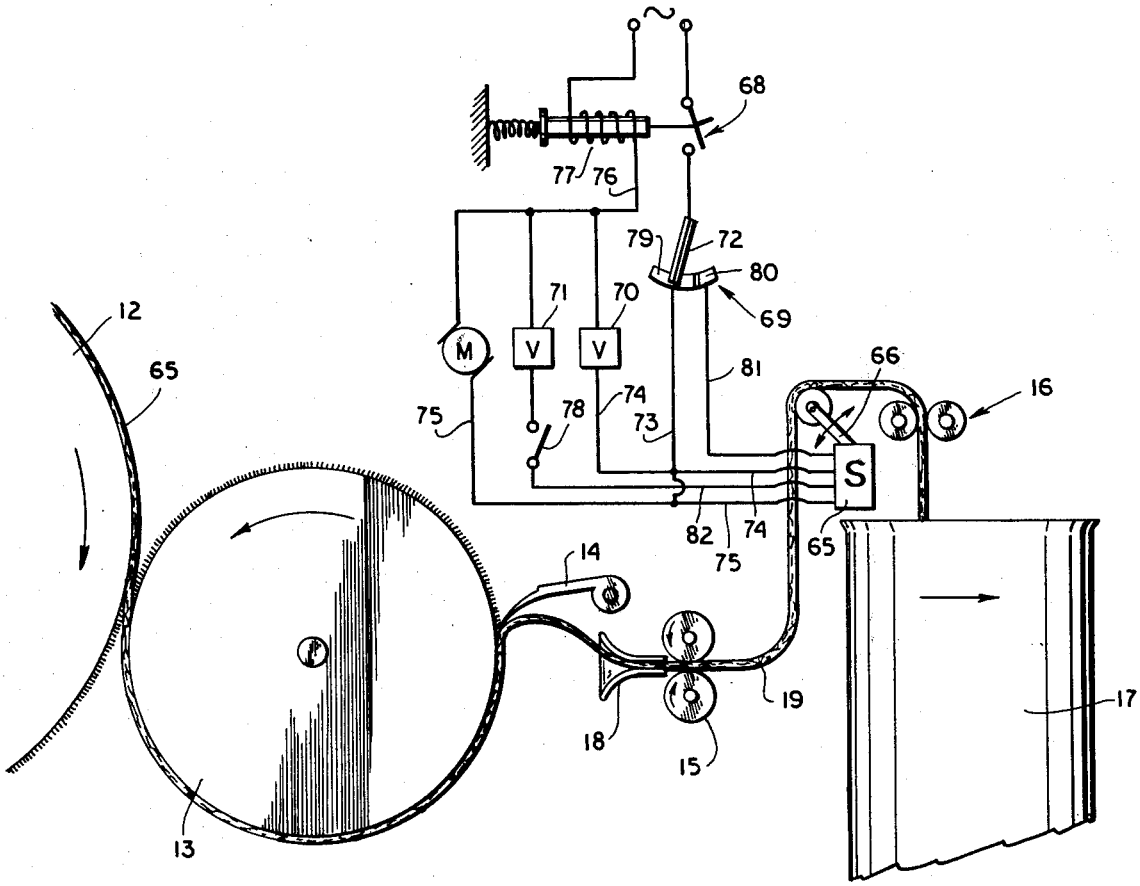
FIG. 3 is a schematic illustration of a time delay and sliver detector control system which controls the variable speed drive system of FIGS. 1 and 2.

Referring now in more detail to the drawing, in which like numerals indicate like parts throughout the several views, FIG. 1 illustrates in schematic form a portion of a textile card 10 which includes a licker-in cylinder 11, main card cylinder 12, and doffing cylinder 13. FIG. 3 illustrates comb 14, calendar rolls 15, trumpet 18, coiler head 16 and sliver coiler can 17.

Figure 2:
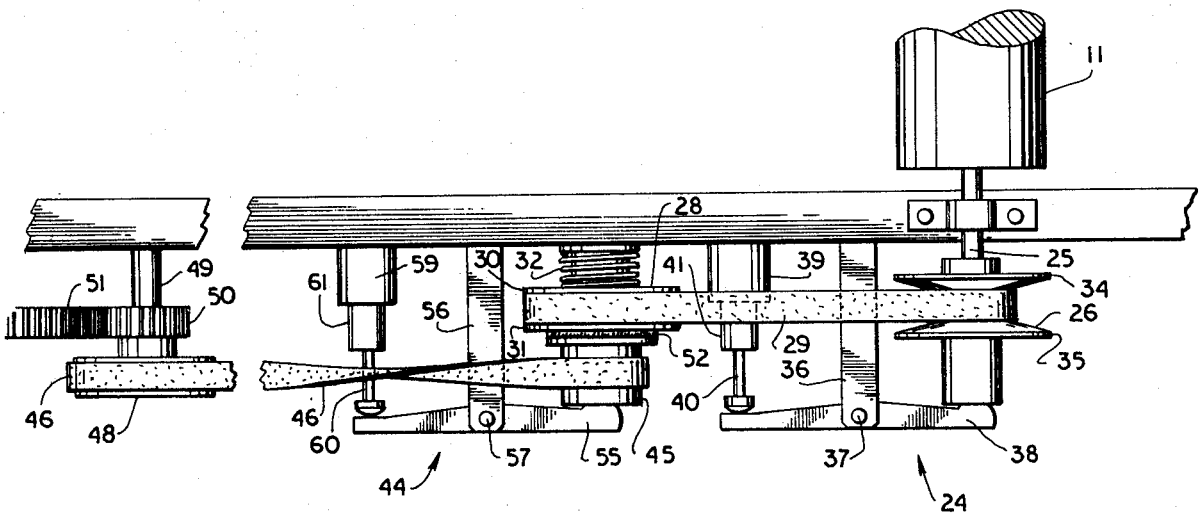
FIG. 2 is a schematic top view of the variable speed system illustrated in FIG. 1, with the elements in the right portion of the Figure turned 90° for clarity.

A mechanical drive system (not illustrated) is provided for rotating main cylinder 12 and licker-in cylinder 11 in the directions as indicated by arrows 20 and 21. Doffing cylinder 13 rotates in the direction as indicated by arrow 22 and is driven by a belt drive system. The belt drive system includes variable speed belt drive system 24 which is powered from the axle 25 of licker-in cylinder 11 and includes a variable width sheave 26 secured to the rotatable axle 25. A complimentary variable width sheave 28 and V-belt 29 are driven by the drive sheave 26. The complementary variable width driven sheave 28 and the variable width driving sheave 26 are of conventional construction in that the complementary driven sheave 28 includes a pair of sheave halves 30 and 31 each mounted on and rotatable with a shaft (not shown), with the sheave half 31 being fixed on the length of the shaft and with sheave half 30 being spring-urged by coil compression spring 32 along the length of the shaft toward fixed sheave half 31. The variable width driving sheave 26 also includes a pair of sheave halves 34 and 35, with the sheave half 34 being rigidly mounted on axle 25 and with sheave half 35 being movable along the length of the axle 25 toward and away from sheave half 34. Rocker arm 38 is mounted outboard of sheaves 26 and 28 and is pivotally supported at its midpoint by brace 36 and pivot pin 37. Fluid operated ram member 39 is supported so that its ram plunger 40 is extendable from its cylinder 41 toward engagement with one end of rocker arm 38, while the other end of the rocker arm extends to a position where it engages the outer sheave half 35 of variable width sheave 26. When ram member 39 causes its plunger 40 to distend, rocker arm 38 is pivoted in a counterclockwise direction (FIG. 2) to force the outer sheave half 35 toward the inner sheave half 34, thereby reducing the width between the sheave halves and causing the V-belt 29 to move away from the axis of rotation of the sheave 26. This causes the linear velocity of V-belt 29 to increase for a given rotational velocity of sheave 26. In order to accommodate the movement of V-belt 29 in an outward direction with respect to variable drive sheave 26, the coil compression spring 32 allows the sheave half 30 to move away from sheave half 31 to increase the distance between the sheave halves and to allow the V-belt 29 to move closer to the axis of rotation of the complementary driven sheave 28. The arrangement of the variable width sheaves, the V-belt, the fluid actuated ram member and rocker arm causes the elements to function as a variable speed belt drive system as the first element for transmitting the rotational movement of the licker-in cylinder to the doffing cylinder.

A second or driven belt drive system 44 is powered by the first or variable speed drive system 24, and includes a flat belt pulley 45, flat belt 46, flat production gear pulley 48, axle 49, driving gear 50 and doffer driving gear 51. Flat belt pulley 45 is mounted on the axle (not shown) of complementary driven sheave 28 of variable speed belt drive system 24 and is freely rotatable with respect to the axle. Disc clutch plate 52 is positioned between the inner surface of flat belt pulley 45 and the outer surface of sheave half 31 of complementary driven sheave 28 so that when flat belt pulley 45 is urged along the length of the axle toward engagement with complementary sheave 28, a clutching action will occur so that the rotational movement of complimentary driven sheave 28 will be imparted to flat belt pulley 45, causing flat belt 46 and flat production gear pulley 48 to be driven in the usual manner.

Rocker arm 55 is mounted on brace 56 and rocks about pivot pin 57. Fluid actuated ram member 59 supports its plunger 60 inside one end of rocker arm 55 so that when its ram cylinder 61 distends plunger 60, the rocker arm will rock in a counterclockwise direction. The opposite end of rocker arm 55 is mounted outboard of flat belt pulley 45, so that the counterclockwise movement (FIG. 2) of rocker arm 55 causes flat belt pulley 45 and its disc clutch to move toward engagement with complimentary driven sheave 28.

Flat production gear pulley 48 is driven by flat belt 46 and is rigidly connected to axle 49 of driving gear 50. Driving gear 50 meshes with doffer driving gear 51. In order that doffing cylinder 13 be driven in the direction as indicated by arrow 22, flat belt 46 is twisted (FIG. 1) so that the direction of rotation imparted to the belt by flat belt pulley 45 is reversed in flat production gear pulley 48.

As illustrated in FIG. 3, the web 19 of fibrous materials that is being worked by the card is doffed from the card cylinder 12 by doffing cylinder 13 and is combed from the doffing cylinder by comb 14 and moved through a trumpet 18 so that the web is formed into a sliver 19. The sliver is moved by calendaring rolls 15 and other guide means (not shown) to the coiler head 16 which is illustrated in schematic form. A sliver detector switch 65 is positioned in the path of the sliver as it moves from the trumpet to the coiler head, and switch 65 includes a pivotal element 66 that is moved in a clockwise direction (FIG. 3) when the sliver 19 is moving properly from the card into the sliver coiler can 17. If the sliver is broken or absent, the pivotal element 66 pivots in a counterclockwise direction. Sliver detector switch 65 is open when the pivotal element 66 is moved in a counterclockwise direction by the absence of a sliver and is closed and maintained in its closed position when a sliver is moving properly into the coiler head.

A timer is used in the variable speed belt drive system to allow the doffing cylinder to be operated at a slow speed during the start-up of the card, and when the timer times out, the belt drive system progressively increases the speed of rotation of the doffing cylinder. FIG. 3 illustrates in elementary schematic form a bimetallic arm timer 69 that might be utilized to provide the desired function; however, it will be understood by those skilled in the art that other timing systems would be utilized. The circuitry includes an on-off switch 68 which includes a holding coil 77, timer 69, sliver detector switch 66, first ram solenoid valve 70, second ram solenoid valve 71 and the motor M used to drive the main cylinder and licker-in cylinder. When on-off switch 68 is closed, a circuit is made through the bimetallic arm 72 of timer 69 through conductor 73 and conductors 74 and 75 to first ram member solenoid valve 70 and to motor M, through conductor 76 and back through the holding coils 77 of the on-off switch. When the switch 68 is first closed, the bi-metallic arm 72 is in engagement with its first contact 79. After a predetermined length of time in which the elements of the bimetallic arm expand unevenly, the bi-metallic arm 72 moves into engagement with contact 80. When in this condition, the bi-metallic arm 72 makes a circuit through conductor 81 sliver detector switch 65 and conductors 74, 75 and 82. Of course, if sliver detector switch 65 is open because the sliver 19 has not been made up to the sliver coiler can 17, no circuit will be made to conductors 74, 75 and 82. If switch 65 is closed, then first ram member solenoid valve 70 remains closed and motor M remains in operation, and second ram member solenoid valve 71 is actuated.

When on-off switch 68 is first closed to initiate the operation of the textile card system, the timer 69 makes a circuit to motor M and first ram member solenoid valve 70 so that the card cylinder, licker-in cylinder and doffing cylinder begin rotation. Also, solenoid valve 70 communicates with ram member 59 and causes its plunger 60 to distend and rock rocker arm 55 in a counterclockwise direction, causing the flat belt pulley 45 to clutch with complementary driven sheave 28. Since the variable width driving sheave 26 is driven by licker-in axle 25 and rotates in unison with the licker-in cylinder, the variable width driving sheave 26 will function to drive its V-belt 29 and rotate its complimentary driven sheave 28. The clutch arrangement of flat belt pulley 45 causes the flat belt pulley 45 to rotate and drive its flat belt 46 and flat production gear pulley 48, thereby imparting rotational movement to the doffing cylinder through driving gear 50 and doffer driving gear 51. Since the variable width driving sheave 26 is still in its expanded condition, the doffing cylinder will be driven during the time-out period at a slow speed.

When timer 69 times out, a circuit will be made to the sliver detector switch 65. If the card operator has made up the sliver to the sliver coiler can, the pivotal element 66 of the sliver detector switch 65 will have moved in a clockwise direction to its closed position, and a circuit will be made from switch 65 through solenoid valve 70 and 71 and motor M. Thus, motor M and solenoid valve 70 are continuously energized, and solenoid valve 71 becomes energized. Solenoid valve 71 communicates with fluid actuated ram member 39 and causes the plunger 40 of the ram member to distend, which causes rocker arm 38 to rock in a counterclockwise direction (FIG. 2) and force the sheave half 35 of variable width sheave 26 toward sheave half 34. This causes the V-belt 29 to progressively assume a larger radius from the axle 25 and a smaller radius from the axle of complementary sheave 28, thereby progressively speeding up the linear movement of V-belt 29 and those elements driven by the belt. This causes doffing cylinder 13 to progressively increase in its rotational speed.

If sliver detector switch 65 does not detect the proper makeup of the sliver coiler can, or if the switch detects a subsequent break in the sliver after initial makeup, the circuit made through switch 65 will be interrupted. The interruption of the circuit to solenoid valve 70 and 71 and to motor M will cause the ram members 39 and 59 to retract and will deenergize motor M and open the on-off switch 68. This causes the unclutching of flat belt pulley 45 from complementary driven sheave 28 and allows the doffing cylinder to stop its rotation independently from the rotation of the other elements of the card and causes the variable width driving sheave 26 to open to a larger width and resume its slow speed configuration. Thus, the system is again placed back into its slow speed condition so that when the operator starts the system again, it will be started at a slow speed.

An additional switch 78 is illustrated in conductor 82 between sliver detector switch 65 and ram solenoid valve 70. Switch 78 is normally closed; however, if it is desired to operate the doffer continuously at its slow speed, switch 78 can be opened to hold solenoid valve 70 in its inactive position.

While the variable speed belt drive system has been disclosed in connection with a textile card system, it will be understood that the same or similar variable speed drive systems can be used in connection with draw frames, rolling frames and other textile equipment. Moreover, it will be understood that the foregoing description relates to specific disclosed embodiments of the present invention, and that numerous alterations and modifications may be made therein without departing from the spirit and the scope of the invention as defined in the following claims.

We claim:

1. In a high production textile card system including a main cylinder, a licker-in cylinder and a doffer cylinder for working fibrous textile material and forming the textile material into a sliver and drive means for driving the main cylinder and the licker-in cylinder, the combination therewith of a variable width sheave belt drive system connected to and continuously driven by a sheave powered from said licker-in cylinder and including a driven variable width sheave, a second belt drive system connected in rotational driving relationship to said doffer cylinder and including a driving pulley, clutch means selectively interconnecting said driving pulley of said second belt drive system and said driven variable width sheave of said variable sheave belt drive system, and time controlled actuating means for engaging and disengaging said clutch means to start and stop the rotation of said doffer cylinder and for varying the width of a sheave of said variable width sheave belt drive system to vary the rotational speed of said doffer cylinder.

2. The combination of claim 1 and wherein said time controlled actuating means further includes a sliver position detector positioned in the path of the sliver for detecting the presence of absence of the sliver moving from said doffer cylinder toward a sliver coiling system and in response to detecting the absence of the sliver moving from said doffer cylinder toward a sliver coiling system disengaging said clutch means to stop the rotation of said doffer cylinder and increasing the width of a sheave of said variable width sheave belt drive system.

3. The combination of claim 1 and wherein said variable width sheave belt drive system includes a fluid actuated ram means responsive to said time controlled actuating means for reducing the width of the sheave powered from said licker-in cylinder whereby the belt speed of said second belt drive system is increased.

* * * * *

UNITED STATES PATENT OFFICE

CERTIFICATE OF CORRECTION

PATENT NO. : 3,982,301

DATED : September 28, 1976

INVENTOR(S) : Lawrence Llach and Arturo Picas

It is certified that error appears in the above-identified patent and that said Letters Patent are hereby corrected as shown below:

On the cover page, the christian name of co-inventor Llach reading "Lawrence" should read --Lorenzo--.

Signed and Sealed this

*Twenty-fifth* Day of *October 1977*

[SEAL]

*Attest:*

RUTH C. MASON
*Attesting Officer*

LUTRELLE F. PARKER
*Acting Commissioner of Patents and Trademarks*